US005671830A

United States Patent [19]

Wood

[11] Patent Number: 5,671,830

[45] Date of Patent: Sep. 30, 1997

[54] BRIEFCASE WITH HIDDEN COMPARTMENTS

[76] Inventor: David G. Wood, 5749 Enfield St., Encino, Calif. 91316

[21] Appl. No.: 557,907

[22] Filed: Nov. 14, 1995

[51] Int. Cl.[6] ..... A45C 3/02; A45C 5/12; A45C 13/18; A45C 15/00

[52] U.S. Cl. ..... 190/101; 150/101; 150/106; 190/106; 190/111; 224/587; 224/911

[58] Field of Search ..... 150/101, 106, 150/102; 190/101, 111, 106, 112; 206/317; 224/911, 914, 192, 198, DIG. 12, 587

[56] References Cited

U.S. PATENT DOCUMENTS

| | | | |
|---|---|---|---|
| 1,381,301 | 6/1921 | Hargrave | 190/101 X |
| 2,213,821 | 9/1940 | McCurdy | 190/111 |
| 2,531,550 | 11/1950 | Bradley et al. | 206/317 |
| 3,261,519 | 7/1966 | Horne | 224/911 X |
| 3,268,130 | 8/1966 | Simpson | 224/911 X |
| 3,347,299 | 10/1967 | Alexander | 150/106 X |
| 4,020,930 | 5/1977 | Weber | 190/111 X |
| 4,102,332 | 7/1978 | Gessman | 128/2.1 A |
| 4,911,272 | 3/1990 | Mainville | 190/106 |
| 5,015,179 | 5/1991 | Resnick | 434/185 |
| 5,067,642 | 11/1991 | Fodge | 224/911 |
| 5,170,919 | 12/1992 | De Santis et al. | 224/911 X |
| 5,203,449 | 4/1993 | Bonardi | 190/118 X |
| 5,495,967 | 3/1996 | Parton | 190/106 X |

FOREIGN PATENT DOCUMENTS

| | | | |
|---|---|---|---|
| 2213267 | 9/1973 | Germany | 190/111 |
| 168235 | 9/1921 | United Kingdom | 150/102 |
| 9008631 | 8/1990 | WIPO | 190/112 |

*Primary Examiner*—Sue A. Weaver
*Attorney, Agent, or Firm*—Oppenheimer Poms Smith

[57] ABSTRACT

A briefcase has hidden spring loaded compartment which, when actuated, exposes the hidden compartment presenting a holstered gun to operative position.

4 Claims, 3 Drawing Sheets

FIG. 2
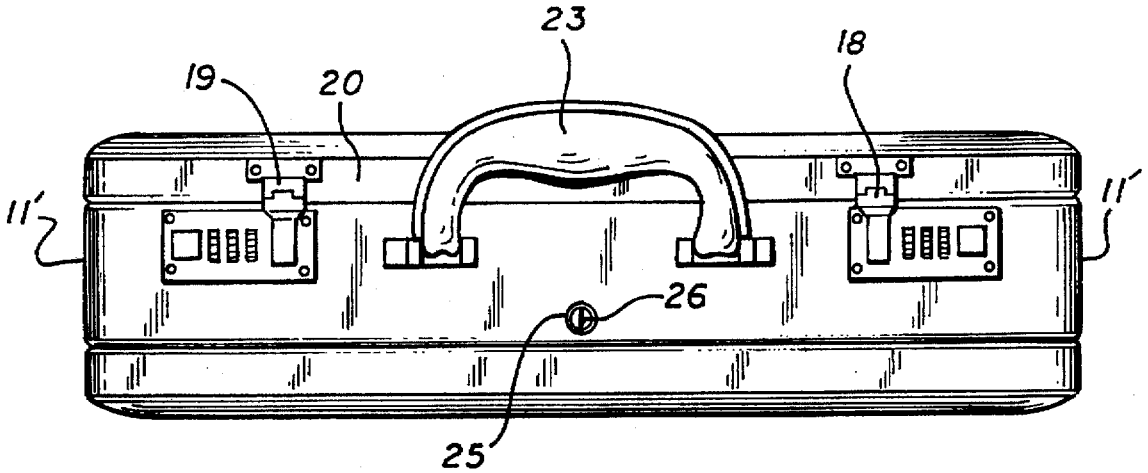
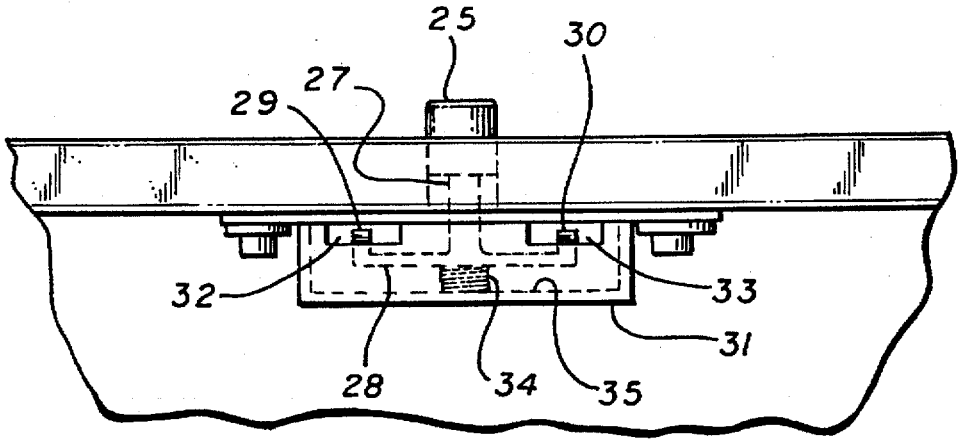
FIG. 3
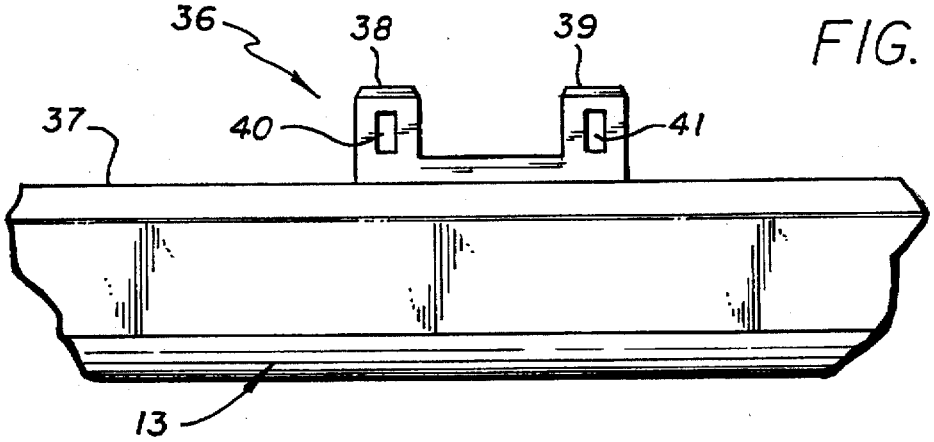
FIG. 4

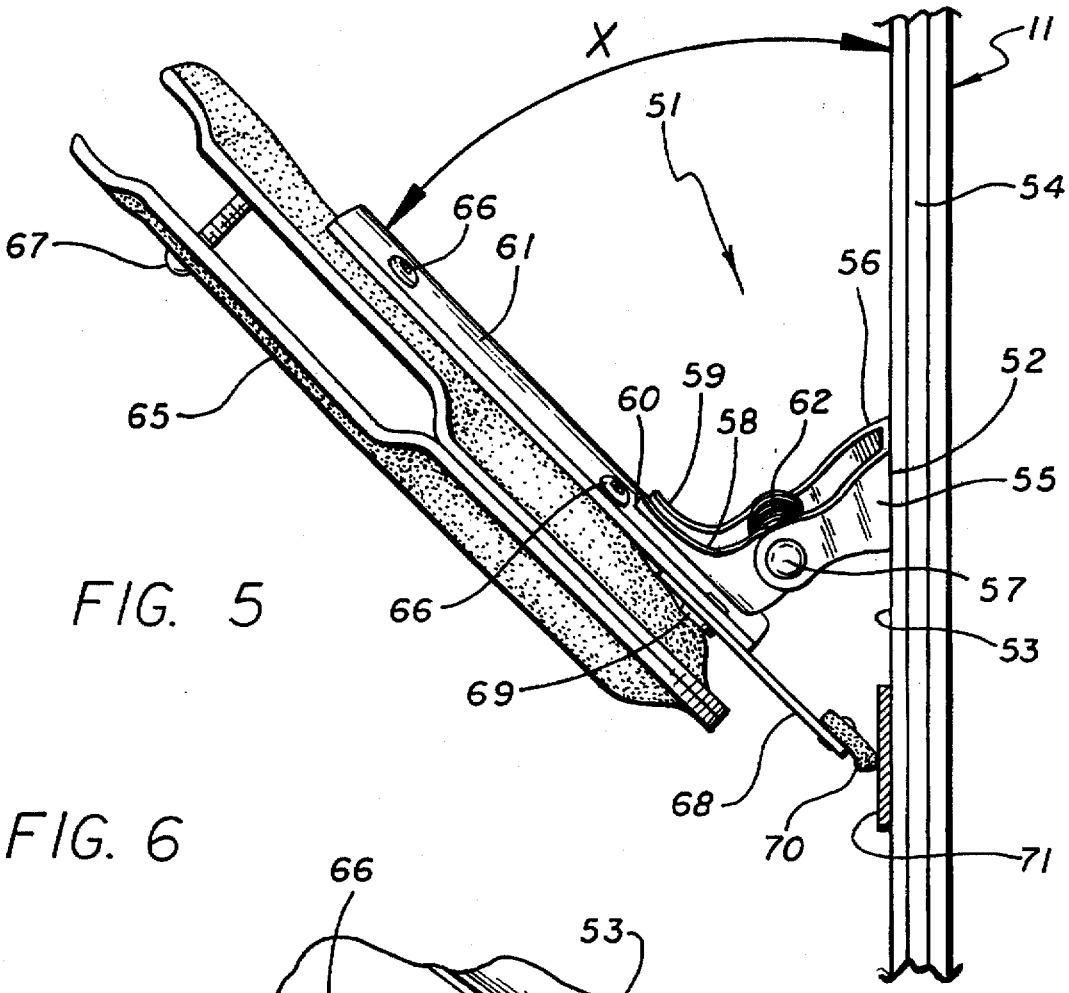
FIG. 5
FIG. 6
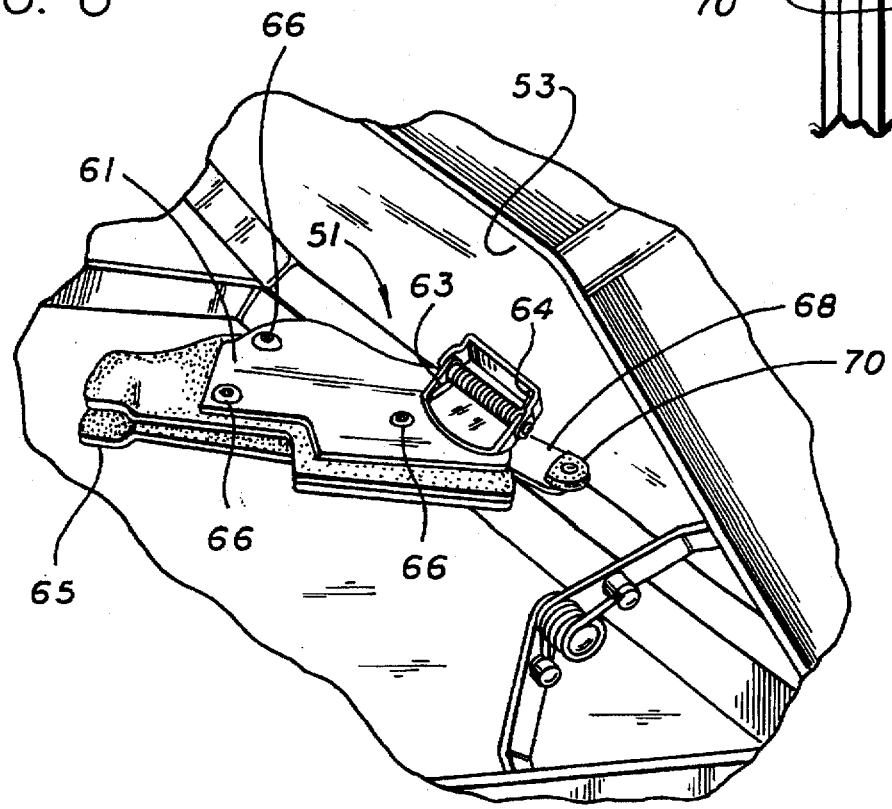

BRIEFCASE WITH HIDDEN COMPARTMENTS

BACKGROUND OF THE INVENTION

1. Field of the Invention

The invention relates to briefcases; and, more particularly, to a conventional briefcase modified to contain a hidden compartment containing a gun therein.

2. Description of the Prior Art

Certain law enforcement personnel have requirements that require them to carry a concealed weapon. Although such weapon may be concealed on their person, it is advantageous to carry the gun in a briefcase or the like that would be in conformation to their demeanor. That is, an agent may be wearing a suit and carrying a briefcase. However, for obvious reasons, it is necessary that the agent have quick access to the gun. The agent may not have time to open the briefcase and reach inside for the gun.

Briefcases with hidden compartments are known in the art. Such a briefcase may have, for example, a file compartment containing an expandable folder on one side and a storage compartment on the other side.

In U.S. Pat. No. 1,381,301 to Hargrave, a gun is fixedly mounted inside of a compartment in the case with the muzzle aligned with a hole through a side wall of the case. The trigger is actuated from the outside of the case firing a bullet from the gun through the hole. Obviously, such an arrangement does not allow quick access to the gun nor allow the same to be carried apart from the briefcase.

There is thus a need for a briefcase having a hidden compartment which can be opened automatically to expose a gun to manually withdraw the same therefrom. Such a briefcase should, for all appearances, look like a conventional briefcase from the exterior.

SUMMARY OF THE INVENTION

It is an object of this invention to provide a briefcase having a hidden compartment for storing a removable gun therein.

It is a further object of this invention to provide such a briefcase which has a hidden compartment that springs to an open position when a push button on the exterior is pushed.

It is still further an object of this invention to provide such a briefcase which exposes a gun in a spring biased holster set at an angle for easy withdrawal of the gun therefrom.

These and other objects are preferably accomplished by providing a briefcase having a hidden spring loaded compartment which, when actuated, exposes the hidden compartment presenting a spring biased holstered gun to an operative angular position for easy and quick withdrawal of the gun therefrom.

BRIEF DESCRIPTION OF THE DRAWING

FIG. 2 is a top plan view of the briefcase of FIG. 1 in a closed position.

FIG. 3 is a view taken along line 3 of FIG. 1;

FIG. 4 is a view taken along line 4 of FIG. 1;

FIG. 5 is a side view, partly in section, of the holster and mounting assembly alone; and FIG. 6 is a detailed view of a portion of the mounting assembly of FIG. 5.

DESCRIPTION OF THE PREFERRED EMBODIMENT

Figure 1:
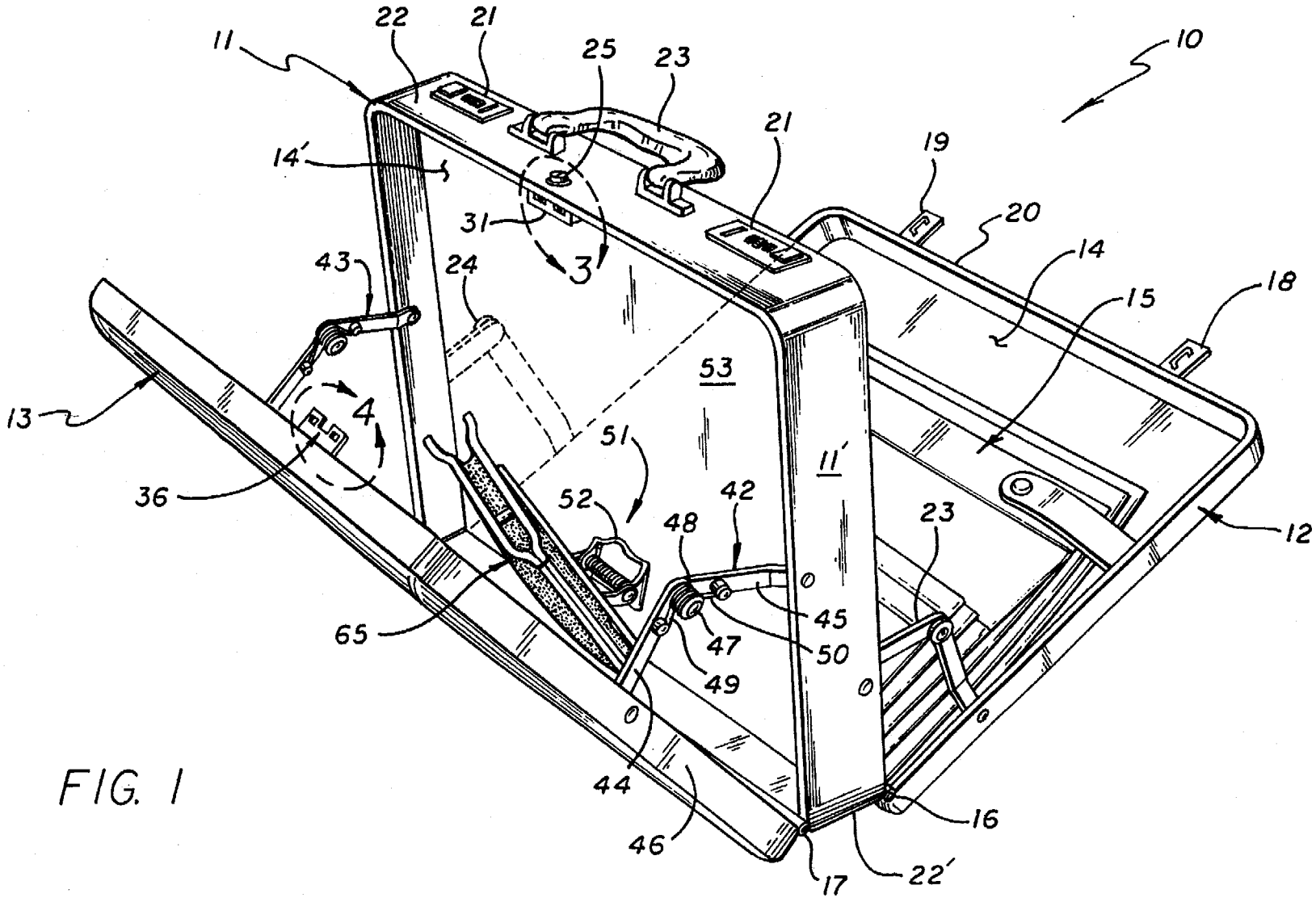
FIG. 1 is a perspective view of a briefcase in accordance with the teachings of the invention showing both compartments thereof exposed to open positions.

Referring now to FIG. 1 of the invention, a briefcase 10 is shown having a main body portion 11 and two side portions 12, 13. Main body portion 11 thus has an outer peripheral wall defined by spaced side walls 11', (see also FIG. 2), top wall 22 and bottom wall 22'. Compartment 14, defined by side portion 12 and main body portion 11, is conventional and may have a suitable paper holding section 15 for storing and retaining papers and the like therein. Side portions 12, 13 are hinged to main body portion 11 by suitable hinges 16, 17, respectively, as is well known in the briefcase art. Suitable releasable spaced latches 18, 19 mounted on the upper wall 20 of side portion 12 are adapted to engage and releasably lock into locking members 21 mounted on the top wall 22 of main body portion 11. A suitable carrying handle 23 is also mounted on top wall 22 for carrying briefcase 10 when side portions 11, 12 are pivoted to the closed position. A pair of spaced hinges 23, 24 interconnect side portion 12 to main body portion 11.

The foregoing describes a conventional briefcase since, as heretofore stated, briefcases having two compartments hingedly secured to a central main body portion on opposite sides thereof are well known in the art.

However, as particularly contemplated in the present invention, the compartment 14', defined by side portion 13 and main body portion 11, is adapted to retain therein a gun holster which springs to an operative position when side portion 13 is opened.

As seen in FIG. 1, a push button 25 is provided on top wall 22 of main body portion 11 adjacent handle 23 and accessible from the outside of briefcase 10. Push button 25 has a keyhole 26 (FIG. 2) therein whereby the push button 25 may be locked into an inoperative position.

As seen in FIG. 3, push button 25 includes an integral shaft 27 extending to a plate 28 having a pair of upstanding tangs 29, 30. Plate 28 is mounted in a housing 31 having a pair of spaced openings or slots 32, 33 accessible from the exterior of housing 31. A spring 34 is disposed between the underside of plate 28 and the bottom wall 35 of housing 31 biasing plate 28 upwardly into the position shown in FIG. 3.

As seen in FIG. 1, a latch plate 36 (see also FIG. 4) extends from the underside of top wall 37 of side portion 13, mounted thereto in any suitable manner, toward housing 31. Plate 36 has a generally U-shaped configuration with spaced flanges 38, 39 having slots 40, 41, respectively, therein.

It is to be understood that, when plate 36 is in the FIG. 2 position, flanges 38, 39 extend through slots 32, 33 in housing 31 with tangs 29, 30 entering slots 40, 41. This retains the side portion 13 in the closed or FIG. 2 position since plate 28 is normally biased into this locking position. When it is desired to release side portion 13 and open it to the FIG. 1 position, push button 25 is pushed downwardly against its spring bias with tangs 29, 30 exiting slots 40, 41. Due to the spring biased bracket assemblies 42, 43, which will now be discussed, side portion 13 springs away from main body portion 11 to the FIG. 1 position.

As seen in FIG. 1, each bracket assembly 42, 43 includes a pair of bracket arms 44, 45, arm 44 being pivotally secured to the inside of the respectively side walls of side portion 13. For example, arm 44 is secured to side wall 46 (FIG. 1). The other arm 45 is pivotally secured to the inside of main body portion 11. Each assembly 42, 43 is identical and each includes a center rivet 47 or the like pivotally securing together the free ends of arms 44, 45. A coil spring 48 is provided having one leg 49 fixedly secured to arm 44 and the other leg 50 fixedly secured to arm 45. If desired, similar coil springs may be provided on the opposite side of arms 44, 45 (not shown). In fact, any suitable number of springs or other types of spring biasing or resilient means may be provided. Thus, unlatching plate 36 springs open side portion 13 due to the resiliency of spring 48.

As seen in FIG. 5, a spring biased mounting plate assembly 51 is provided having a plate 52 (FIG. 1) riveted or otherwise secured to the inner wall 53 of main body portion 11 which may be reinforced by an inner aluminum plate 54 (FIG. 5), if desired. Plate 52 has a pair of spaced integral arms 55, 56 pivotally secured, via pivot pin 57, to a pair of spaced arms 58, 59, respectively (See FIG. 6). Arms 58, 59 are integral with plate 60 mounted to a flange plate 61. A coil spring 62 encircles pivot pin 57 terminating in spaced ends 63, 64 secured to plate 52 and plate 60, respectively. Spring 62 normally biases plate 61 to the FIG. 1 position.

A gun holder or holster 65 (FIG. 5) is mounted to plate 61 by one or more threaded screws 66. As is well known in the art, conventional tensioning screw 67 may be provided on holster 65 for adjusting the inner spacing thereof and thus the tension on a gun inserted therein.

Holster 65 is maintained, as seen in FIG. 5, at an angle x of about 45° with respect to the plane of wall 53. The spacing between holster 65 and the inner wall of side portion 13 is such that, when side portion 13 is moved to the closed position of FIG. 2, it can abut against holster 65 and move it toward wall 53 against the bias of spring 62. Thus, when side portion 13 is opened, holster 65 springs to the FIG. 5 operative position allowing the user to withdraw a gun from holster 65.

As seen in FIG. 5, stopping plate 68 is fixedly secured to both the lower end of plate 61 and plate 60 by means of pivot screw 69. Plate 68 has a resilient bumper 70 secured to its lower end abutting against a stop plate 71 mounted on inner wall 53. This arrangement maintains holster 65 in the angled position x. When it is desired to remove or replace holster 65, plates 61, 68 can be pivoted about screw 69 to the position shown in FIG. 6. That is, the bias of spring 62 moves plates 61, 68 away from wall 53 so that screws 66 are accessible. Thus, screws 66 may be loosened to remove holster 65 from plate 61 and the plates 61, 68 can then be pivoted back to the FIG. 5 position thereby allowing substitution of a different size or type of holster.

It can thus be seen that there is described a briefcase having a hidden compartment concealing a gun, the compartment being opened from a push button accessible on the exterior of the briefcase. The hidden compartment springs open and a holster, also spring loaded, springs to an operative position. Any suitable pistol or gun may be mounted on the holster, such as a semi-automatic pistol. Screws 66 can be unthreaded to disengage the holster 65 from plate 61 allowing quick replacement of another holster for a different type of gun or pistol.

Plate 54 may be any suitable dimensions, such as 12"× 12", about 1/16" thick and riveted or otherwise secured therein.

The swing arm action of plates 61, 68 allows one to move the same from the operative FIG. 5 position to the exposed position of FIG. 6 where the holster can be removed and replaced.

Although a particular embodiment of the invention has been disclosed, variations thereof may occur to an artisan and the scope of the invention should be limited only by the scope of the appended claims.

I claim:

1. A briefcase having a main body portion said main body portion being defined by an outer peripheral wall having a pair of spaced side walls, a top wall interconnecting said walls and a bottom wall interconnecting said side walls, said peripheral wall surrounding an inner wall attached to said outer peripheral wall;

a first side portion closing off said inner wall and forming therebetween a first inner compartment;

a second side portion closing off said inner wall and forming therebetween a second inner compartment;

both of said first and second side portions being hingedly secured to said main body portion along the bottom wall thereof;

locking means associated with said first side portion and said top wall of said main body portion for lockably securing said first side portion to said top wall;

said second portion being releasably secured to the top wall of said main body portion, said second side portion having a peripheral wall comprised of a top wall and spaced side walls interconnected to said last-mentioned top wall, and a bottom wall interconnected to said last-mentioned side walls, a latch plate mounted on the top wall of said second side portion releasably engageable with a locking member mounted on the top wall of said main body portion;

resiliently biased push button means mounted on the top wall of said main body portion associated with said locking member for releasably unlocking said latch plate from locking engagement in said locking member whereby actuation of said push button means, when said latch plate is locked to said locking member, releases said latch plate from engagement with said locking member allowing said second side portion to spring away from said main body portion due to the resilient hinged securement of said second side portion to said main body portion;

spring biased gun holster mounted in said second inner compartment, said inner compartment being defined by said inner wall of said main body portion an inner wall of said second side portion, and the peripheral walls of said main body portion and said second side portion and spring biased mounting means mounted to the inner wall of said main body portion having said holster mounted thereon said mounting means including a first mounting plate fixedly secured to the inner wall of said main body portion and a second mounting plate secured to said holster, said first and second mounting plates being pivotally secured together by a pivot pin, and a spring encircling said pivot pin having one free end secured to one of said mounting plates and the other free end secured to the other of said mounting plates said second mounting plate is pivotally secured to a holster backing plate; and a stopping assembly having a stopping plate mounted on the inner wall of said main body portion, a stop member pivotally secured to both said backing plate and said second mounting plate and a resilient member attached to said stop member and engaging said stopping plate and abutting thereagainst in a first position holding said holster at an angle with respect to said inner wall and movable to a second position out of abutting engagement with said stopping plate.

2. In the briefcase of claim 1 wherein said holster is removably secured to said backing plate.

3. In the briefcase of FIG. 1 wherein said angle is about 45°.

4. In the briefcase of claim 1 wherein said locking member includes a housing having a pair of spaced open slots therein, said push button means including a push button having an integral shaft extending into said housing, said shaft terminating in a spring biased tang plate having a pair of spaced tangs extending upwardly therefrom toward said push button and normally disposed within said slots, said locking member comprising said tangs when engaged with said latch plate, said latch plate having a pair of spaced flanges, each of said last mentioned flanges having slots therein, said tangs being receivable in said last mentioned slots when said latch plate is moved into said housing thereby locking said latch plate to said locking member until said push button is pushed downwardly moving said spring biased tang plate and thus said tangs downwardly out of engagement with said latch plate.

* * * * *